US011322296B2

(12) United States Patent
Mikogami et al.

(10) Patent No.: US 11,322,296 B2
(45) Date of Patent: May 3, 2022

(54) PULSE TRANSFORMER AND CIRCUIT MODULE HAVING THE SAME

(71) Applicant: TDK CORPORATION, Tokyo (JP)

(72) Inventors: Tasuku Mikogami, Tokyo (JP); Shuhei Someya, Tokyo (JP); Syun Ashizawa, Tokyo (JP); Setu Tsuchida, Yamagata (JP)

(73) Assignee: TDK CORPORATION, Tokyo (JP)

( * ) Notice: Subject to any disclaimer, the term of this patent is extended or adjusted under 35 U.S.C. 154(b) by 474 days.

(21) Appl. No.: 16/504,082

(22) Filed: Jul. 5, 2019

(65) Prior Publication Data

US 2020/0013541 A1 Jan. 9, 2020

(30) Foreign Application Priority Data

Jul. 9, 2018 (JP) ..... JP2018-129764

(51) Int. Cl.
*H01F 27/29* (2006.01)
*H01F 27/24* (2006.01)
*H01F 27/28* (2006.01)

(52) U.S. Cl.
CPC ..... *H01F 27/29* (2013.01); *H01F 27/24* (2013.01); *H01F 27/2804* (2013.01); *H01F 27/2823* (2013.01)

(58) Field of Classification Search
CPC ..... H01F 27/29; H01F 27/24; H01F 27/2804; H01F 27/2823; H01F 19/08; H01F 27/006; H01F 2027/065
See application file for complete search history.

(56) References Cited

U.S. PATENT DOCUMENTS

2013/0049914 A1* 2/2013 Huang ..... H01F 27/292 336/192
2013/0229254 A1* 9/2013 Lee ..... H01F 27/263 336/220
2014/0292463 A1* 10/2014 Lai ..... H01F 27/29 336/192
2016/0155561 A1* 6/2016 Takagi ..... H01F 27/2823 336/222
2016/0240305 A1* 8/2016 Igarashi ..... H01F 27/2828
2017/0004919 A1* 1/2017 Dinh ..... H01F 41/10
2017/0011843 A1* 1/2017 Mikogami ..... H01F 27/2828
2017/0194085 A1* 7/2017 Takagi ..... H01F 27/29
2017/0196093 A1* 7/2017 Takagi ..... H01F 3/10
2017/0229227 A1* 8/2017 Igarashi ..... H01F 17/045

FOREIGN PATENT DOCUMENTS

JP 2014199906 A 10/2014

* cited by examiner

*Primary Examiner* — Mang Tin Bik Lian
(74) *Attorney, Agent, or Firm* — Young Law Firm, P.C.

(57) ABSTRACT

Disclosed herein is a pulse transformer that includes first to fourth terminal electrodes provided on the first flange part, fifth to eighth terminal electrodes provided on the second flange part, first and second wires wound around the winding core part having one end connected to the first and second terminal electrodes and other end connected to the seventh and eighth terminal electrodes, and third and fourth wire wound around the winding core part having one end connected to third and fourth terminal electrodes and other end connected to the fifth and sixth terminal electrodes. A winding direction of the first and third wires is opposite to a winding direction of the second and fourth wires.

8 Claims, 8 Drawing Sheets

PULSE TRANSFORMER AND CIRCUIT MODULE HAVING THE SAME

BACKGROUND OF THE INVENTION

Field of the Invention

The present invention relates to a pulse transformer and a circuit module having the same and, more particularly, to an eight-terminal type pulse transformer having four terminal electrodes on each of a pair of flanges and a circuit module having the same.

Description of Related Art

As the eight-terminal type pulse transformer having four terminal electrodes in each of a pair of flanges, a pulse transformer described in JP 2014-199906 A is known. In the eight-terminal type pulse transformer, two terminal electrodes of the four terminal electrodes provided on one flange are used as primary-side signal terminals, and two terminal electrodes of the four terminal electrodes provided on the other flange are used as secondary-side signal terminals. Further, the remaining two terminal electrodes of the four terminal electrodes provided on the one flange are short-circuited on a circuit board so as to be used as a secondary-side center tap, and the remaining two terminal electrodes of the four terminal electrodes provided on the other flange are short-circuited on the circuit board so as to be used as a primary-side center tap.

When a plurality of the pulse transformers described in JP 2014-199906 A are mounted on a circuit board, the positions of the center tap and signal terminal are interchanged between adjacent pulse transformers to bring the center taps of the adjacent transformers close to each other. An example in which a set of pins 31*a* and a set of pins 42*a* are used as a primary-side center tap is disclosed in FIG. 3A of JP 2014-199906 A.

However, in the configuration disclosed in JP 2014-199906 A, although the center taps on one side can be brought close to each other between the adjacent pulse transformers, the center taps on the other side are separated from each other. Specifically, in the example illustrated in FIG. 3A of JP 2014-199906 A, a set of pins 31*a* and a set of pins 42*a* functioning as a primary-side center tap can be brought close to each other, while a set of pins 34*a* and a set of pins 43*a* functioning as a secondary-side center tap are significantly separated from each other.

As described above, when a conventional eight-terminal type pulse transformer is used in a configuration where two pulse transfers are mounted adjacent to each other on the circuit board, both the primary-side center tap and secondary-side center tap of one pulse transformer cannot be brought close to the primary-side center tap and secondary-side center tap of the other pulse transformer, respectively.

SUMMARY

It is therefore an object of the present invention to provide a pulse transformer and a circuit module having the same capable of, when two pulse transformers are mounted adjacent to each other on a circuit board, bringing both the primary-side center tap and secondary-side center tap of one pulse transformer close to the primary-side center tap and secondary-side center tap of the other pulse transformer, respectively.

A pulse transformer according to the present invention includes: a core having a winding core part axially extending in a first direction, a first flange part provided at axial one end of the winding core part, and a second flange part provided at the axial other end of the winding core part; first, second, third, and fourth terminal electrodes which are provided on the first flange part and arranged in this order in a second direction perpendicular to the first direction; fifth, sixth, seventh, and eighth terminal electrodes which are provided on the second flange part and whose positions in the second direction coincide with the first, second, third, and fourth terminal electrodes, respectively; a first wire which is wound around the winding core part in one direction and which has one end connected to one of the first and second terminal electrodes and the other end connected to one of the seventh and eighth terminal electrodes; a second wire which is wound around the winding core part in the direction opposite to the one direction and which has one end connected to the other one of the first and second terminal electrodes and the other end connected to the other one of the seventh and eighth terminal electrodes; a third wire which is wound around the winding core part in the one direction and which has one end connected to one of the third and fourth terminal electrodes and the other end connected to one of the fifth and sixth terminal electrodes; and a fourth wire which is wound around the winding core part in the direction opposite to the one direction and which has one end connected to the other one of the third and fourth terminal electrodes and the other end connected to the other one of the fifth and sixth terminal electrodes.

According to the present invention, the seventh and eighth terminal electrodes can be used as, e.g., a primary-side center tap, and the third and fourth terminal electrodes can be used as, e.g., a secondary-side center tap, so that the primary-side and secondary-side center taps can be collectively disposed at one side in the second direction of the pulse transformer. Thus, when two pulse transformers are mounted adjacent to each other on a circuit board, both the primary-side center tap and secondary-side center tap of one pulse transformer can be brought close to the primary-side center tap and secondary-side center tap of the other pulse transformer, respectively.

A circuit module according to the present invention includes: a circuit board having a first mounting area; and a first pulse transformer mounted in the first mounting area and having the same structure as the pulse transformer described above. The circuit board has a first conductor pattern that short-circuits the seventh and eighth terminal electrodes of the first pulse transformer and a second conductor pattern that short-circuits the third and fourth terminal electrodes of the first pulse transformer.

According to the present invention, the first conductor pattern can be used as, e.g., the primary-side center tap, and the second conductor pattern can be used as, e.g., the secondary-side center tap.

In the present invention, the circuit board may further has a second mounting area in which a second pulse transformer having the same structure as the pulse transformer described above is mounted and which is disposed adjacent to the first mounting area in the second direction, a third conductor pattern that short-circuits the fifth and sixth terminal electrodes of the second pulse transformer, and a fourth conductor pattern that short-circuits the first and second terminal electrodes of the second pulse transformer. With this configuration, the third conductor pattern can be used as, e.g., the primary-side center tap, and the fourth conductor pattern can be used as, e.g., the secondary-side center tap.

In this case, the first and third conductor patterns may be short-circuited on the circuit board, and the second and fourth conductor patterns may be short-circuited on the circuit board. The first and third conductor patterns are brought close to each other in the second direction, and the second and fourth conductor patterns are brought close to each other in the second direction, so that an efficient pattern layout can be achieved on the circuit board.

As described above, according to the present invention, when two pulse transformers are mounted adjacent to each other on a circuit board, the primary-side center tap and secondary-side center tap of one pulse transformer can be brought close to the primary-side center tap and secondary-side center tap of the other pulse transformer, respectively.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
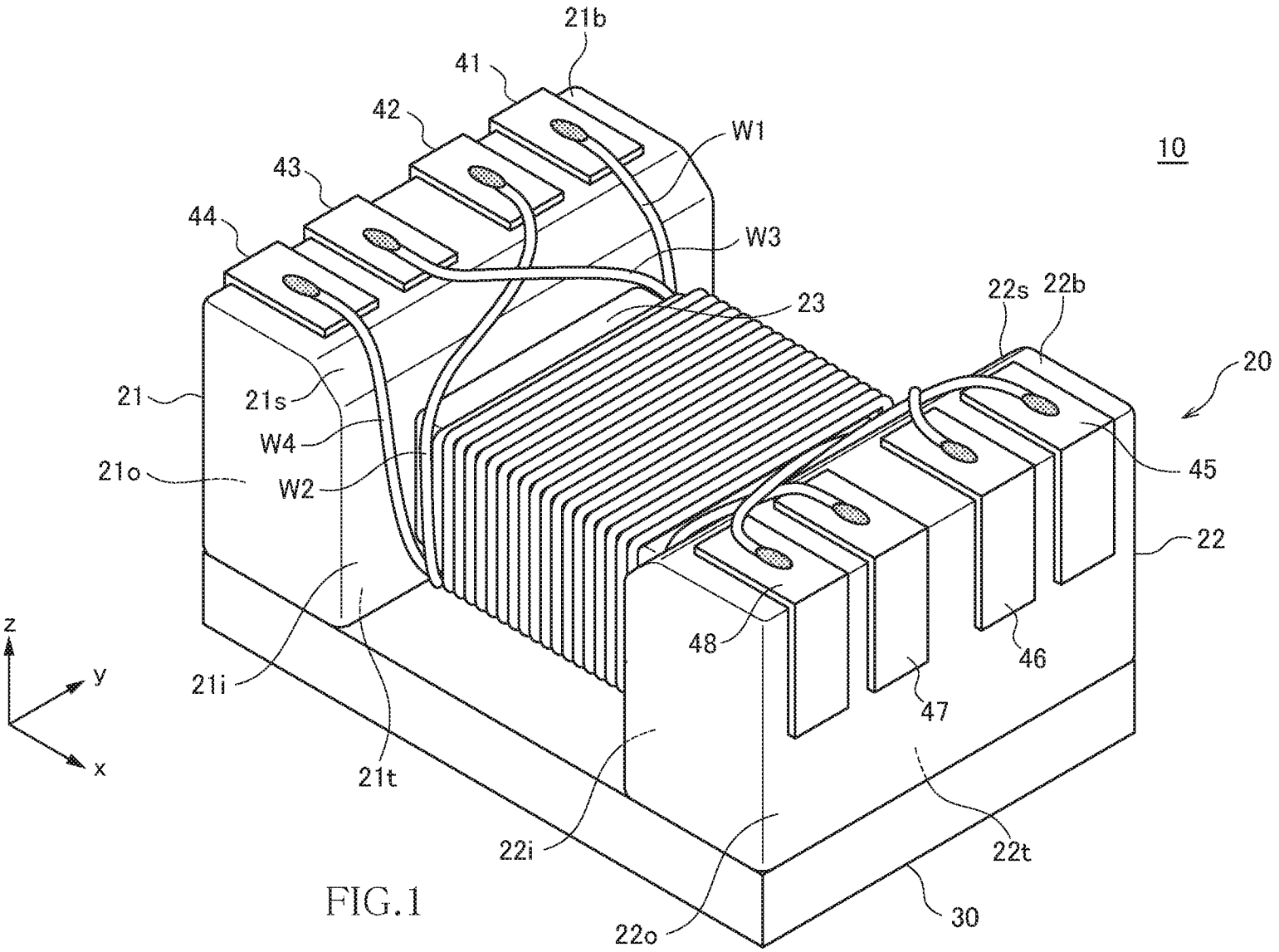
FIG. 1 is a schematic perspective view illustrating the outer appearance of a pulse transformer according to an embodiment of the present invention.

FIG. 1 is a schematic perspective view illustrating the outer appearance of a pulse transformer 10 according to an embodiment of the present invention.

As illustrated in FIG. 1, the pulse transformer 10 according to the present embodiment includes a drum core 20, a plate-like core 30, eight terminal electrodes 41 to 48, and four wires W1 to W4.

The drum core 20 includes a winding core part 23, a first flange part 21 provided at one end of the winding core part 23 in the axial direction (x-direction) thereof, and a second flange part 22 provided at the other end of the winding core part 23 in the axial direction. The drum core 20 is a block made of a high-permeability material such as ferrite and is obtained by integrally forming the flange parts 21, 22 and winding core part 23. While the yz cross section (cross section perpendicular to the axial direction) of the winding core part 23 is substantially rectangular, the corners thereof may be chamfered by barrel polishing. The cross section of the winding core part 23 may not necessarily be rectangular but may have a shape, e.g., a polygonal shape other than a rectangle, such as a hexagon or an octagon. Further, the winding core part 23 may partially have a curved surface.

The first flange part 21 has an inside surface 21*i* connected to the winding core part 23, an outside surface 210 facing away from the inside surface 21*i*, a bottom surface 21*b* facing a substrate at mounting, and a top surface 21*t* facing away from the bottom surface 21*b*. The inside surface 21*i* and outside surface 210 each constitute the yz plane, and the bottom surface 21*b* and top surface 21*t* each constitute the xy plane. Similarly, the second flange part 22 has an inside surface 22*i* connected to the winding core part 23, an outside surface 22*o* facing away from the inside surface 22*i*, a bottom surface 22*b* facing the substrate at mounting, and a top surface 22*t* facing away from the bottom surface 22*b*. The inside surface 22*i* and outside surface 22*o* each constitute the yz plane, and the bottom surface 22*b* and top surface 22*t* each constitute the xy plane. In the present embodiment, the corner between the bottom surface 21*b* and the inside surface 21*i* of the first flange part 21 is chamfered to form a slope 21*s*. Similarly, the corner between the bottom surface 22*b* and the inside surface 22*i* of the second flange part 22 is chamfered to form a slope 22*s*.

The plate-like core 30 is bonded to the top surface 21*t* of the first flange part 21 and the top surface 22*t* of the second flange part 22. The plate-like core 30 is a plate-like member made of a high-permeability material such as ferrite and constitutes a closed magnetic path together with the drum core 20. The plate-like core 30 may be made of the same material as the drum core 20.

As illustrated in FIG. 1, four terminal electrodes 41 to 44 are provided on the first flange part 21. The terminal electrodes 41 to 44 are arranged in this order in the y-direction and each have an L-like shape that covers the bottom surface 21*b* and outside surface 21*o*. The first terminal electrode 41 is connected with one end of the first wire W1, the second terminal electrode 42 is connected with one end of the second wire W2, the third terminal electrode 43 is connected with one end of the third wire W3, and the fourth terminal electrode 44 is connected with one end of the fourth wire W4.

Similarly, four terminal electrodes 45 to 48 are provided on the second flange part 22. The terminal electrodes 45 to 48 are arranged in this order in the y-direction and each have an L-like shape that covers the bottom surface 22*b* and outside surface 22*o*. The positions of the terminal electrodes 45 to 48 in the y-direction coincide with the positions of the terminal electrodes 41 to 44 in the y-direction, respectively. The fifth terminal electrode 45 is connected with the other end of the third wire W3, the sixth terminal electrode 46 is connected with the other end of the fourth wire W4, the seventh terminal electrode 47 is connected with the other end of the first wire W1, and the eighth terminal electrode 48 is connected with the other end of the second wire W2.

The terminal electrodes 41 to 48 may each be a terminal metal fitting bonded to the drum core 20 or may each be directly formed on the drum core 20 using a conductive paste.

The first and third wires W1 and W3 and the second and fourth wires W2 and W4 are wound in the opposite directions. Thus, as illustrated in the circuit diagram of FIG. 2, a pulse transformer is constituted, in which the first and second terminal electrodes 41 and 42 function as a pair of primary-side terminals, the fifth and sixth terminal electrodes 45 and 46 function as a pair of secondary-side terminals, the seventh and eighth terminal electrodes 47 and 48 function as a primary-side center tap, and the third and fourth terminal electrodes 43 and 44 function as a secondary-side center tap.

Here, the primary side and secondary side are defined conveniently, and they may be reversed. Further, the relationship between the center tap and the signal electrode may be reversed. That is, the third and fourth terminal electrodes 43 and 44 may be used as a pair of signal terminals (primary side or secondary side), the seventh and eighth terminal electrodes 47 and 48 may be used as a pair of signal terminals (secondary side or primary side), the first and second terminal electrodes 41 and 42 may be used as one center tap (secondary side or primary side), and the fifth and sixth terminal electrodes 45 and 46 may be used as the other center tap (primary side or secondary side).

The two terminals (e.g., first and second terminal electrodes 41 and 42) constituting the pair of primary-side terminals are terminals that input or output primary-side differential signals. Similarly, the two terminals (e.g., fifth and sixth terminal electrodes 45 and 46) constituting the pair of secondary-side terminals are terminals that input or output secondary-side differential signals. The two terminals (e.g., seventh and eighth terminal electrodes 47 and 48) constituting the primary-side center tap are short-circuited on a circuit board to be described later and are applied with a predetermined reference potential (e.g., a ground potential). Similarly, the two terminals (e.g., third and fourth terminal electrodes 43 and 44) constituting the secondary-side center tap are short-circuited on the circuit board to be described later and are applied with a predetermined reference potential (e.g., a ground potential).

Figure 2:
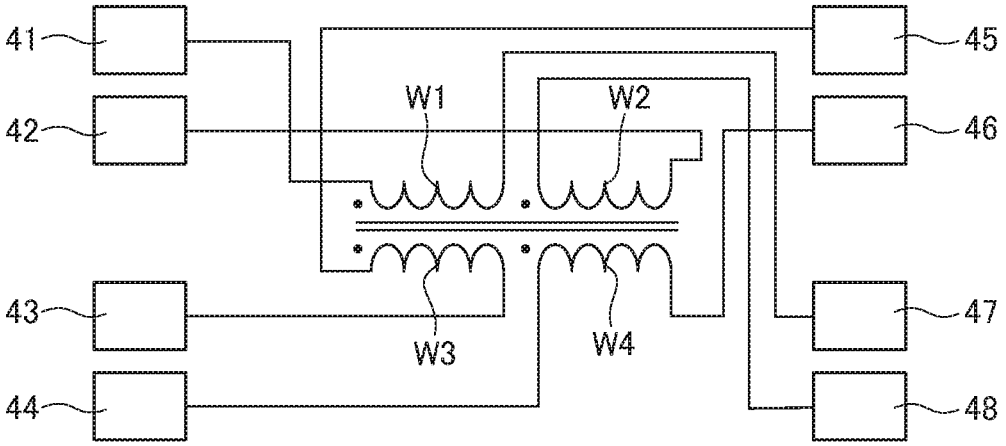
FIG. 2 is an equivalent circuit diagram of the pulse transformer.

The connection relationship between the first and second terminal electrodes 41 and 42 and the first and second wires W1 and W2 is not limited to that illustrated in FIGS. 1 and 2 and may be reversed. The connection relationship between the third and fourth terminal electrodes 43 and 44 and the third and fourth wires W3 and W4 is also not limited to that illustrated in FIGS. 1 and 2 and may be reversed. The connection relationship between the fifth and sixth terminal electrodes 45 and 46 and the third and fourth wires W3 and W4 is also not limited to that illustrated in FIGS. 1 and 2 and may be reversed. The connection relationship between the seventh and eighth terminal electrodes 47 and 48 and the first and second wires W1 and W2 is also not limited to that illustrated in FIGS. 1 and 2 and may be reversed.

FIGS. 3 to 6 are each a simplified plan view for explaining a manufacturing method for the pulse transformer 10 according to the present embodiment.

Figure 3:
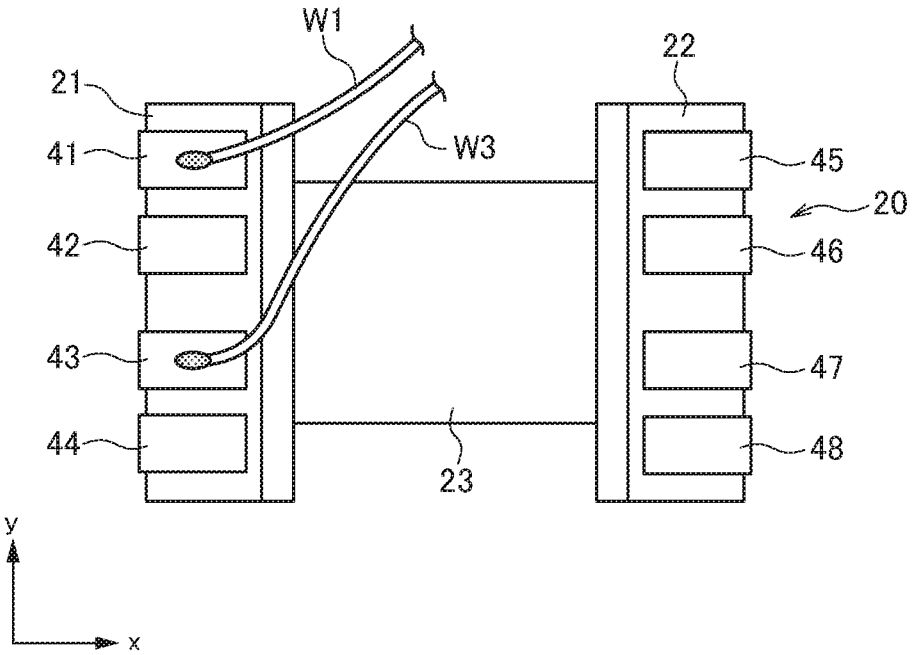
FIGS. 3 to 6 are simplified plan views for explaining a manufacturing method for the pulse transformer.

First, the drum core 20 is prepared, and the terminal electrodes 41 to 44 are formed on the first flange part 21, and the terminal electrodes 45 to 48 are formed on the second flange part 22. Subsequently, as illustrated in FIG. 3, one end of the first wire W1 is connected to the first terminal electrode 41, and one end of the third wire W3 is connected to the third terminal electrode 43. Specifically, the first and third wires W1 and W3 are disposed above the first and third terminal electrodes 41 and 43, respectively, and then a heating head is pressed against the first and third wires W1 and W3 to thermocompression bond the first and third wires W1 and W3 onto the first and third terminal electrodes 41 and 43, respectively. In this state, the drum core 20 is rotated in one direction to wind the first and third wires W1 and W3 around the winding core part 23 of the drum core 20.

Figure 4:
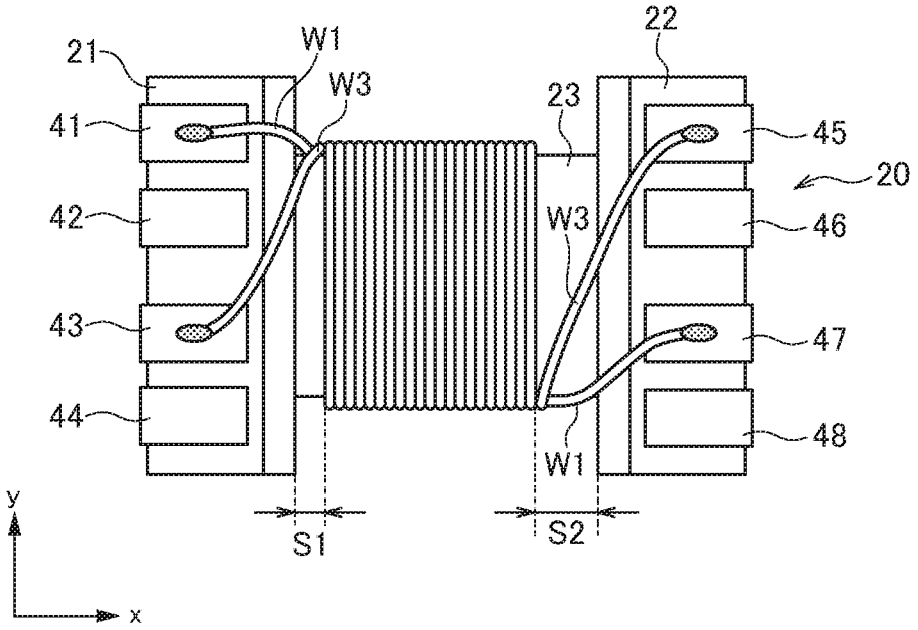

After the first and third wires W1 and W3 are wound around the winding core part 23 a predetermined number of times, the other end of the first wire W1 is connected to the seventh terminal electrode 47, and the other end of the third wire W3 is connected to the fifth terminal electrode 45, as illustrated in FIG. 4. The connection method is the above-mentioned thermocompression bonding. As a result, winding work of the first and third wires W1 and W3 is completed, and a lower winding layer constituted of the first and third wires W1 and W3 is formed on the winding core part 23. At this time, the lower winding layer is preferably disposed offset to the first flange part 21 side. In other words, the first and third wires W1 and W3 are preferably wound such that a space S1 formed between the inside surface 21*i* of the first flange part 21 and the lower winding layer is narrower than a space S2 formed between the inside surface 22*i* of the second flange part 22 and the lower winding layer. This is because by narrowing the space S1 formed at the first flange part 21 side that is the winding-start side, the space S2 formed at the second flange part 22 side that is the winding-end side can be widen correspondingly, thereby ensuring a sufficient margin in the winding work.

Figure 5:
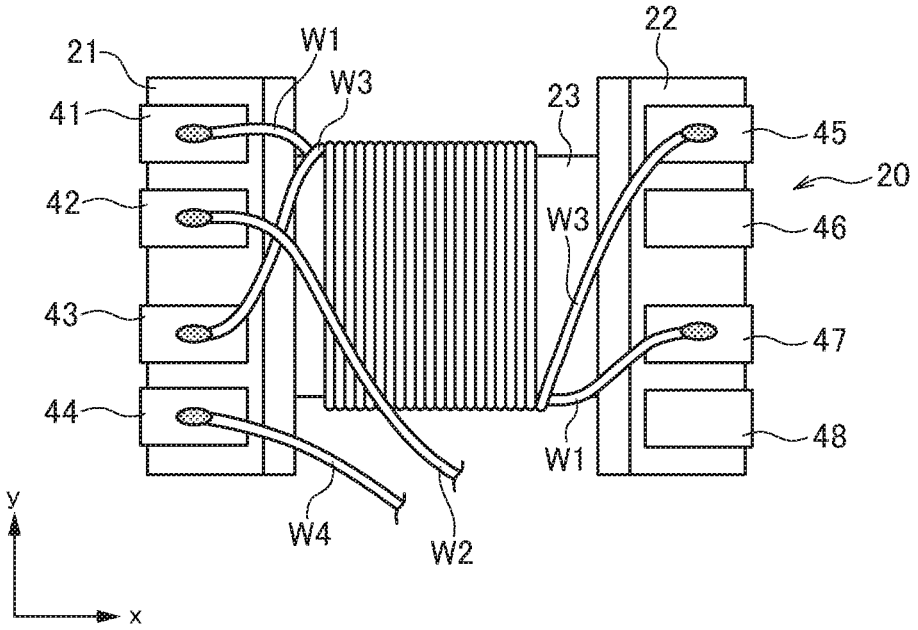
Figure 6:
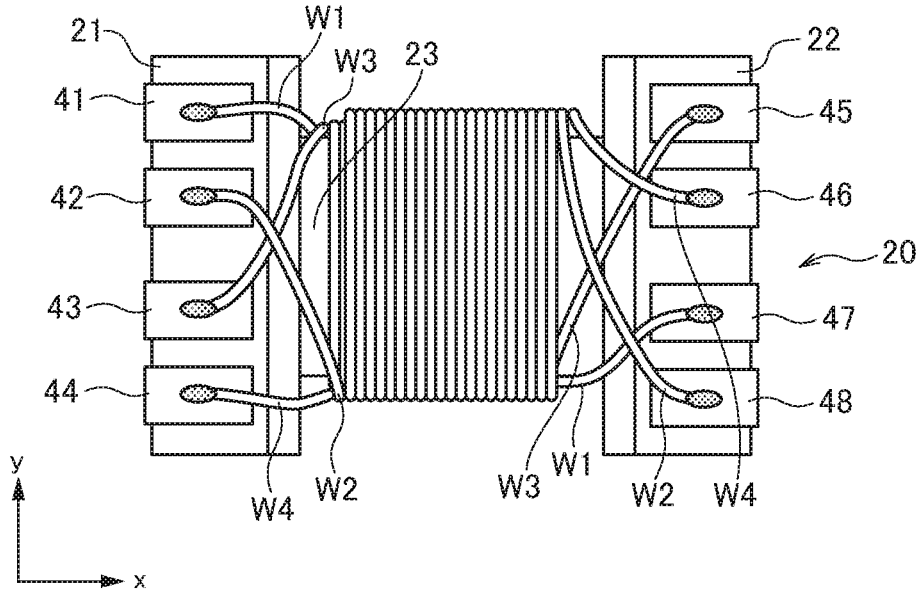

Subsequently, as illustrated in FIG. 5, one end of the second wire W2 is connected to the second terminal electrode 42, and one end of the fourth wire W4 is connected to the fourth terminal electrode 44. The connection method is the above-mentioned thermocompression bonding. In this state, the drum core 20 is rotated in the reverse direction to wind the second and fourth wires W2 and W4 around the winding core part 23 of the drum core 20. After the second and fourth wires W2 and W4 are wound around the winding core part 23 a predetermined number of times, the other end of the second wire W2 is connected to the eighth terminal electrode 48, and the other end of the fourth wire W4 is connected to the sixth terminal electrode 46, as illustrated in FIG. 6. The connection method is the above-mentioned thermocompression bonding.

As a result, winding work of the second and fourth wires W2 and W4 is completed and, in the winding core part 23, an upper winding layer constituted of the second and fourth wires W2 and W4 is formed on the lower winding layer constituted of the first and third wires W1 and W3. The upper winding layer is also preferably disposed offset to the first flange part 21 side for the same reason as above. That is, the entire winding block constituted of the upper and lower winding layers is preferably disposed offset to the first flange part 21 side.

Then, the plate-like core 30 is bonded to the top surfaces 21*t* and 22*t* of the respective flange parts 21 and 22 and, finally, the pulse transformer 10 according to the present embodiment is completed.

Figure 7:
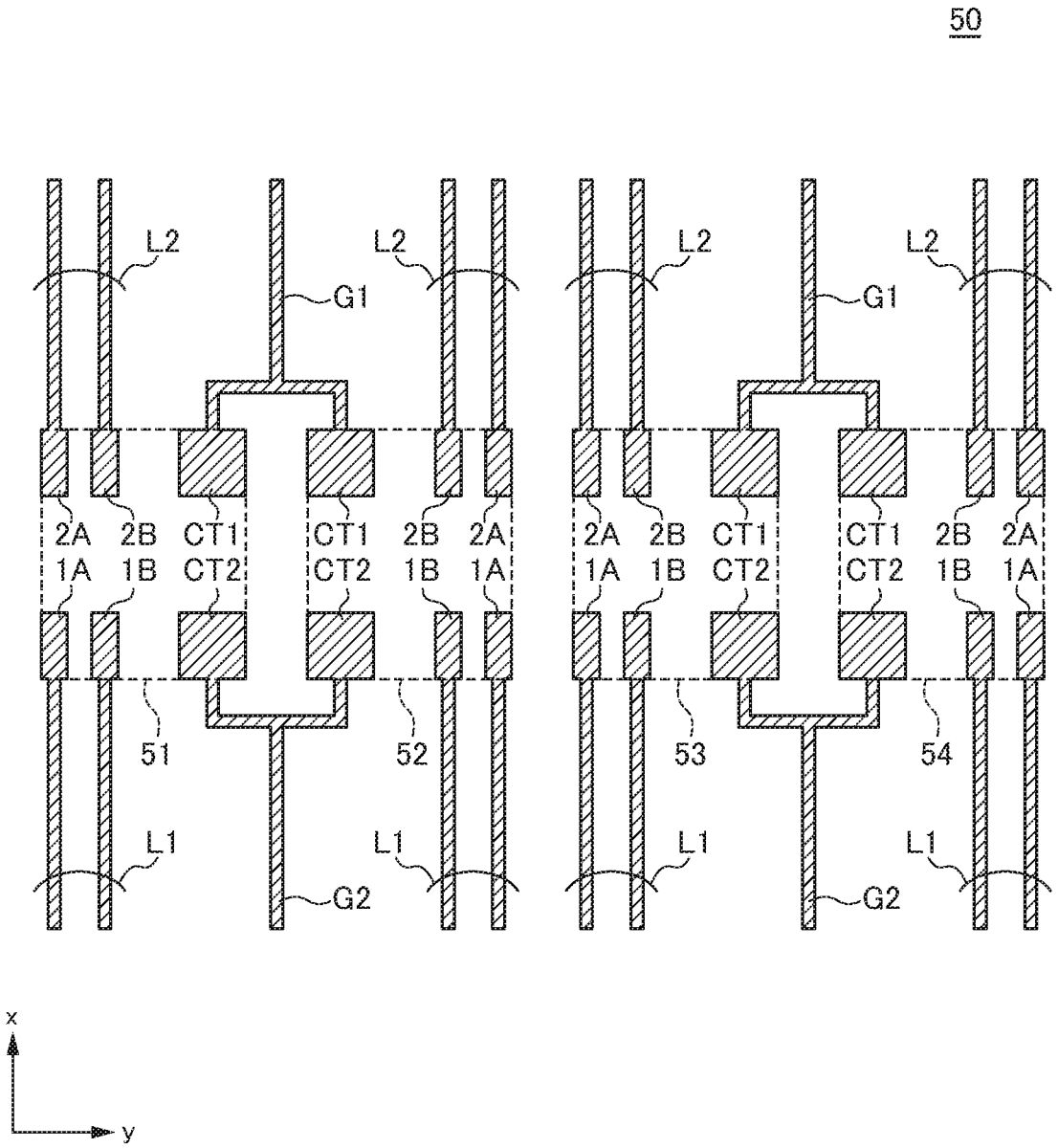
FIG. 7 is a plan view illustrating a conductor pattern on a circuit board on which the pulse transformer is mounted.

FIG. 7 is a plan view illustrating a conductor pattern on a circuit board on which the pulse transformer 10 is mounted.

Figure 8:
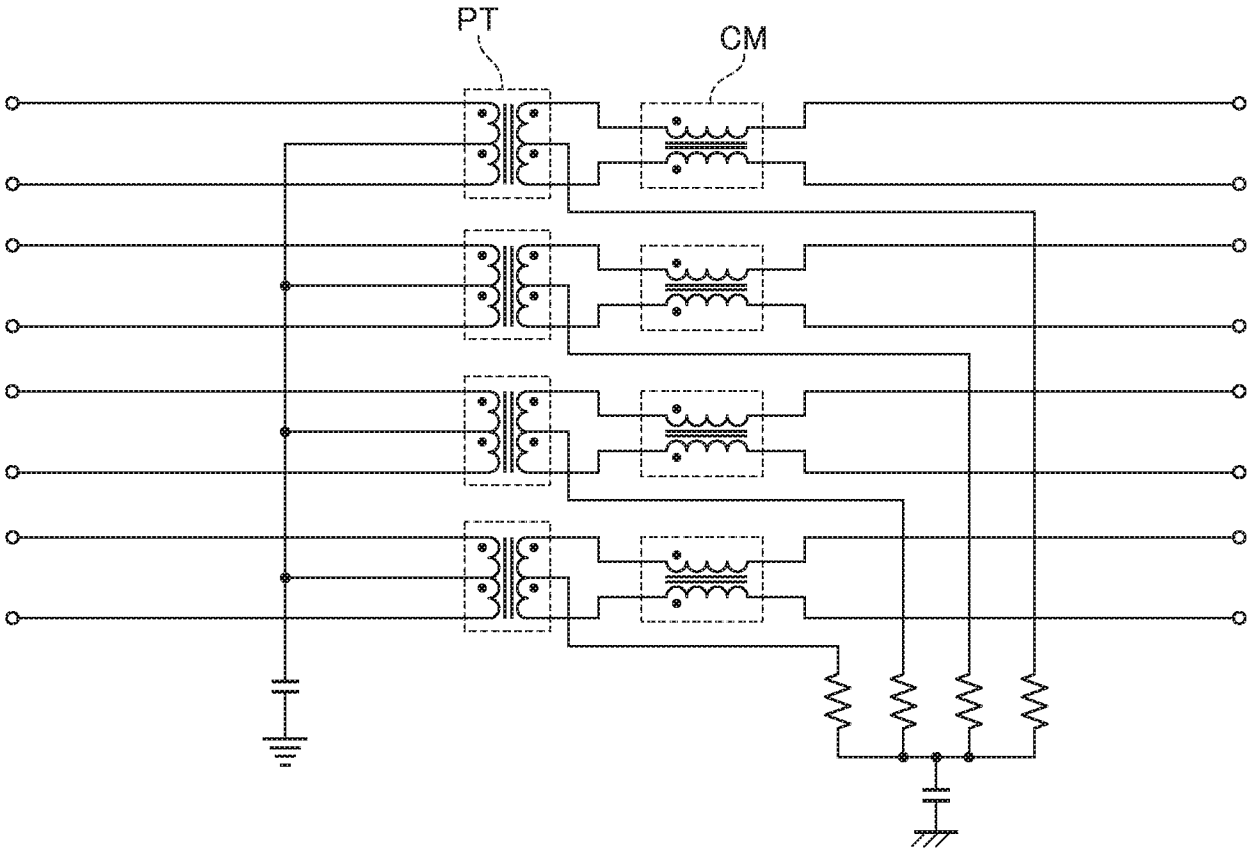
FIG. 8 is a circuit diagram of a LAN connector circuit (1000Base)

In the example of FIG. 7, four mounting areas 51 to are assigned to a circuit board 50, and the pulse transformers 10 according to the present embodiment are mounted to their corresponding one of the mounting areas 51 to 54. The mounting areas 51 to 54 are disposed close to each other in the y-direction so as to achieve high-density mounting on the circuit board 50. Such a layout is required, for example, when the pulse transformer 10 according to the present embodiment is used in a LAN connector circuit (1000Base) illustrated in FIG. 8. As illustrated in FIG. 8, the LAN connector circuit uses a plurality of pulse transformers PT and a plurality of common mode filters CM, so that when the above components are mounted at a high density, the mounting areas 51 to 54 may be close to each other as illustrated in FIG. 7.

As illustrated in FIG. 7, land patterns 1A, 1B, 2A, 2B, CT1, and CT2 are provided in each of the mounting areas 51 to 54. The land patterns 1A and 1B are connected to a pair of primary-side signal lines L1, and the land patterns 2A and 2B are connected to a pair of secondary-side signal lines L2.

The land pattern CT1 is connected to a ground line G1 constituting a primary-side center tap, and the land pattern CT2 is connected to a ground line G2 constituting a secondary-side center tap.

When the pulse transformer 10 is mounted on each of the mounting areas 51 to 54, the eight terminal electrodes 41 to 48 provided on the pulse transformer 10 are connected to their corresponding one of the land patterns 1A, 1B, 2A, 2B, CT1, and CT2. Specifically, in the pulse transformer 10 mounted on each of the mounting areas 52 and 54, the terminal electrodes 41 and 42 are connected respectively to the land patterns 1A and 1B, the terminal electrodes 45 and 46 are connected respectively to the land patterns 2A and 2B, the terminal electrodes 47 and 48 are both connected to the land pattern CT1, and the terminal electrodes 43 and 44 are both connected to the land pattern CT2. On the other hand, in the pulse transformer 10 mounted on each of the mounting areas 51 and 53, the terminal electrodes 43 and 44 are connected respectively to the land patterns 1A and 1B, the terminal electrodes 47 and 48 are connected respectively to the land patterns 2A and 2B, the terminal electrodes 45 and 46 are both connected to the land pattern CT1, and the terminal electrodes 41 and 42 are both connected to the land pattern CT2.

Thus, in the pulse transformer 10 mounted on each of the mounting areas 52 and 54, the terminal electrodes 41 and 42 function as a pair of primary-side terminals, the terminal electrodes 45 and 46 function as a pair of secondary terminals, the terminal electrodes 47 and 48 function as a primary-side center tap, and the terminal electrodes 43 and 44 function as a secondary-side center tap. On the other hand, in the pulse transformer 10 mounted on each of the mounting areas 51 and 53, the terminal electrodes 43 and 44 function as a pair of primary-side terminals, the terminal electrodes 47 and 48 function as a pair of secondary terminals, the terminal electrodes 45 and 46 function as a primary-side center tap, and the terminal electrodes 41 and 42 function as a secondary-side center tap.

With this configuration, the land patterns CT1 assigned to the mounting areas 51 and 52 (or mounting areas 53 and 54) can be disposed adjacent to each other in the y-direction, and the land patterns CT2 can also be disposed adjacent to each other in the y-direction. This allows the primary-side center taps included in the two respective pulse transformers 10 to be easily connected to their common ground line G1 and allows the secondary-side center taps included in the two respective pulse transformers 10 to be easily connected to their common ground line G2. That is, the land pattern CT1 on the mounting area 51 and the land pattern CT1 on the mounting area 52 can be connected to each other without using a through hole conductor or the like, and the land pattern CT2 on the mounting area 51 and the land pattern CT2 on the mounting area 52 can be connected to each other without using a through hole conductor or the like.

Figure 9:
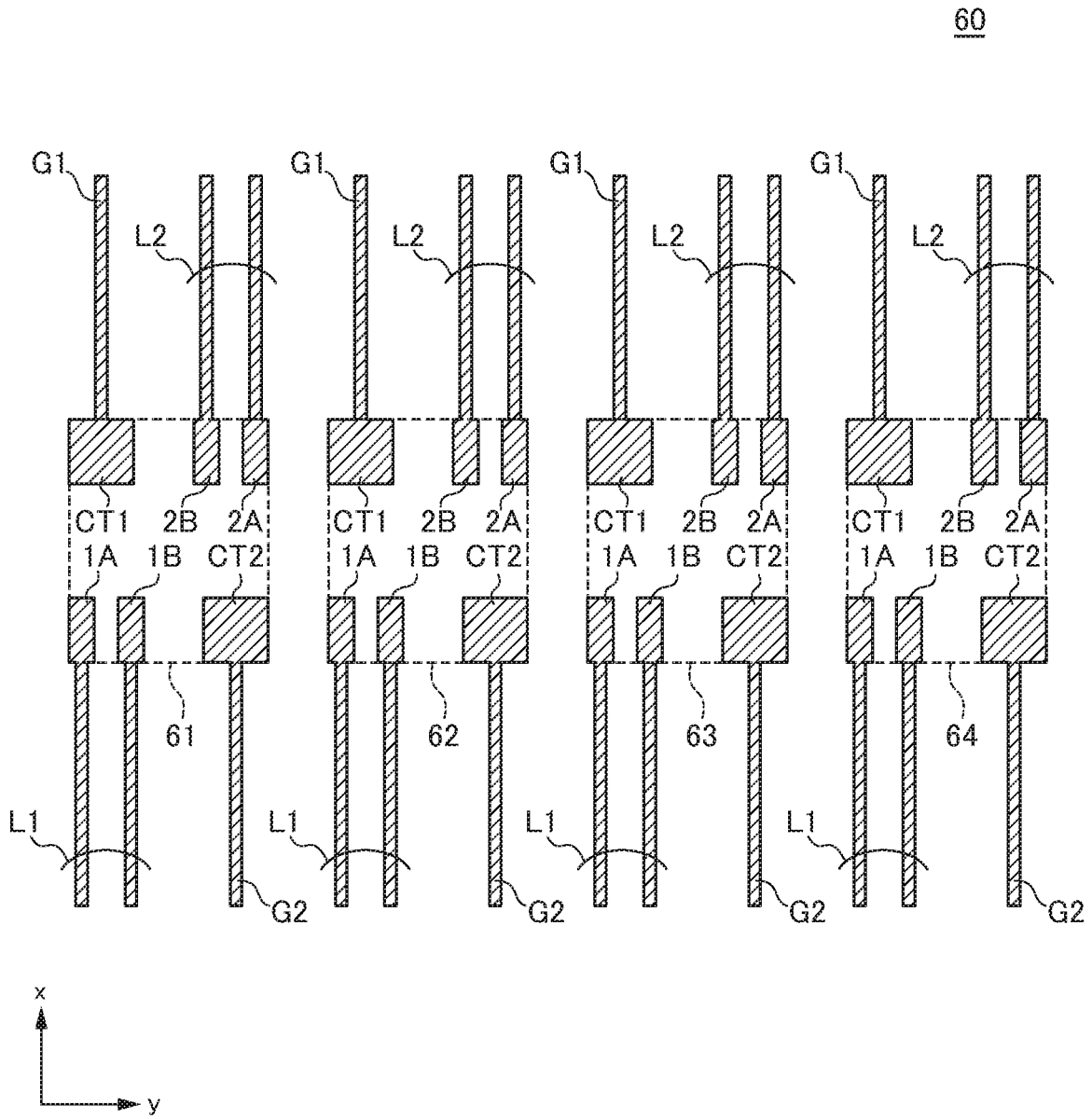
FIG. 9 is a plan view illustrating a conductor pattern on a circuit board on which a general pulse transformer is mounted.

FIG. 9 is a plan view illustrating a conductor pattern on a circuit board on which a general pulse transformer is mounted. In the pulse transformer of this example, a pair of primary-side terminals and a primary-side center tap are arranged in the x-direction, and a pair of secondary-side terminals and a secondary-side center tap are arranged in the x-direction. Accordingly, in mounting areas 61 to 64 of a circuit board 60 on which the pulse transformer of this example is mounted, it is necessary to arrange the land patterns 1A and 1B and the land pattern CT1 in the x-direction and to arrange the land patterns 2A and 2B and the land pattern CT2 in the x-direction, as illustrated in FIG. 9. Thus, when the pulse transformers of this example are mounted on the mounting areas 61 to 64, respectively, it is necessary to individually lay out the ground lines G1 and G2 for each of the mounting areas 61 to 64, so that a plurality of ground lines G1 or a plurality of ground lines G2 cannot be made common unless a through hole conductor or the like is used. This may reduce a degree of freedom in layout on the circuit board and increase the occupancy area of the conductor pattern.

On the other hand, when the pulse transformer 10 according to the present embodiment is used, the pattern illustrated in FIG. 7 can be laid out on the circuit board, so that it is possible to not only increase a degree of freedom in layout, but also reduce the occupancy area of the conductor pattern on the circuit board.

Figure 10:
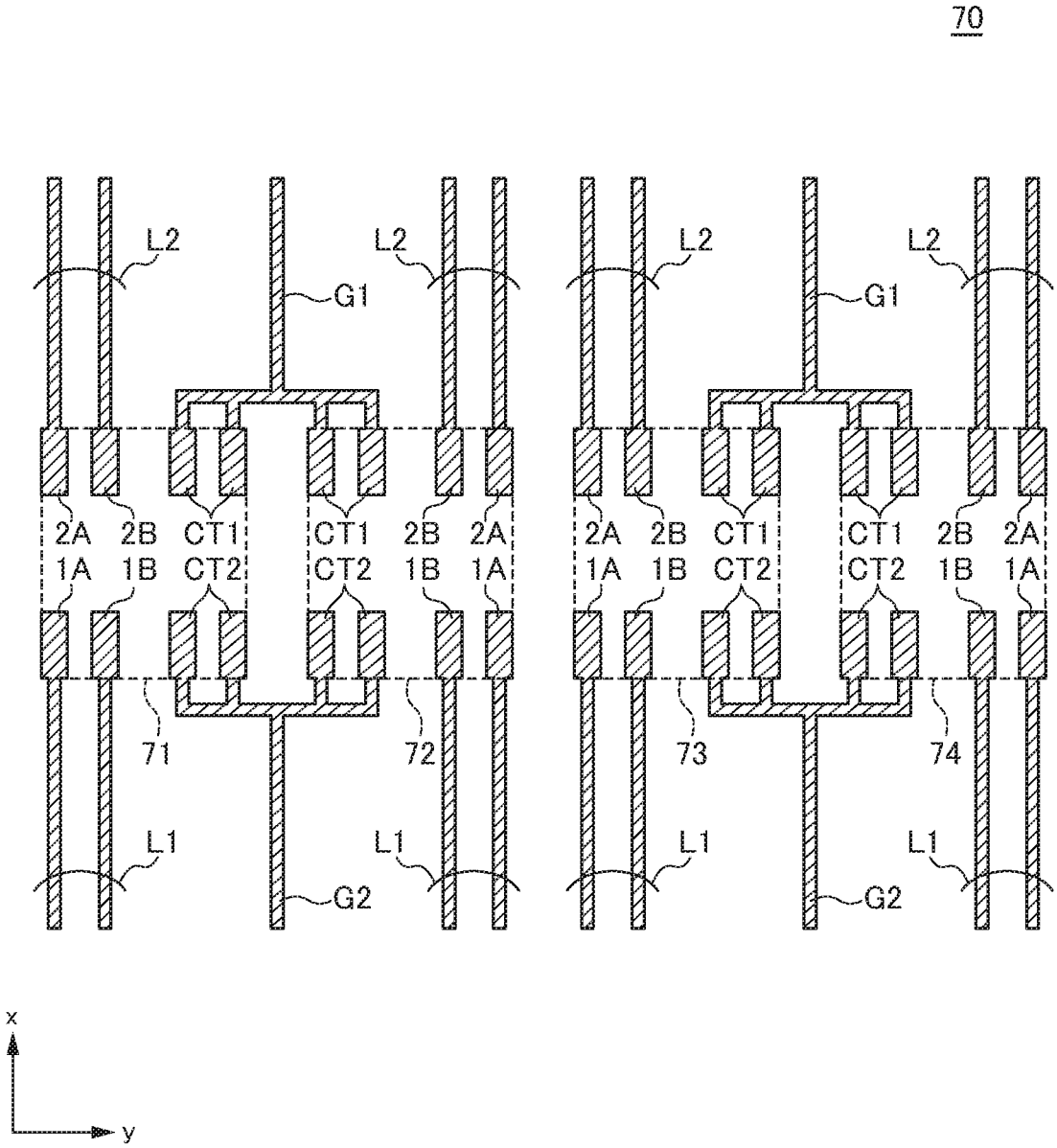
FIG. 10 is a plan view illustrating another conductor pattern on a circuit board on which the pulse transformer is mounted.

The pattern layout on the circuit board is not limited to that illustrated in FIG. 7. For example, like a circuit board 70 illustrated in FIG. 10, the land patterns CT1 and CT2 may each divided into two parts in each of mounting areas 71 to 74. In this case, a total of eight land patterns corresponding to the eight respective terminal electrodes 41 to 48 are formed.

It is apparent that the present invention is not limited to the above embodiments, but may be modified and changed without departing from the scope and spirit of the invention.

What is claimed is:

1. A pulse transformer comprising:

a core having a winding core part axially extending in a first direction, a first flange part provided at one end of the winding core part in the first direction, and a second flange part provided at other end of the winding core part in the first direction;

first, second, third, and fourth terminal electrodes provided on the first flange part and arranged in this order in a second direction perpendicular to the first direction;

fifth, sixth, seventh, and eighth terminal electrodes provided on the second flange part and whose positions in the second direction substantially coincide with the first, second, third, and fourth terminal electrodes, respectively;

a first wire wound around the winding core part in one direction and having one end connected to one of the first and second terminal electrodes and other end connected to one of the seventh and eighth terminal electrodes;

a second wire wound around the winding core part in a direction opposite to the one direction and having one end connected to other one of the first and second terminal electrodes and other end connected to other one of the seventh and eighth terminal electrodes;

a third wire wound around the winding core part in the one direction and having one end connected to one of the third and fourth terminal electrodes and other end connected to one of the fifth and sixth terminal electrodes; and a fourth wire wound around the winding core part in the direction opposite to the one direction and having one end connected to other one of the third and fourth terminal electrodes and other end connected to other one of the fifth and sixth terminal electrodes.

2. The pulse transformer as claimed in claim 1, wherein the first and third wires form a lower winding layer on the winding core part, and wherein the second and fourth wires form an upper winding layer on the lower winding layer.

3. The pulse transformer as claimed in claim 1, further comprising a plate-like core bonded to the first and second flange parts.

4. A circuit module comprising:

a circuit board having a first mounting area; and a first pulse transformer mounted on the first mounting area, wherein the first pulse transformer comprises:

a core having a winding core part axially extending in a first direction, a first flange part provided at one end of the winding core part in the first direction, and a second flange part provided at other end of the winding core part in the first direction;

first, second, third, and fourth terminal electrodes provided on the first flange part and arranged in this order in a second direction perpendicular to the first direction;

fifth, sixth, seventh, and eighth terminal electrodes provided on the second flange part and whose positions in the second direction substantially coincide with the first, second, third, and fourth terminal electrodes, respectively;

a first wire wound around the winding core part in one direction and having one end connected to one of the first and second terminal electrodes and other end connected to one of the seventh and eighth terminal electrodes;

a second wire wound around the winding core part in a direction opposite to the one direction and having one end connected to other one of the first and second terminal electrodes and other end connected to other one of the seventh and eighth terminal electrodes;

a third wire wound around the winding core part in the one direction and having one end connected to one of the third and fourth terminal electrodes and other end connected to one of the fifth and sixth terminal electrodes; and a fourth wire wound around the winding core part in the direction opposite to the one direction and having one end connected to other one of the third and fourth terminal electrodes and other end connected to other one of the fifth and sixth terminal electrodes, wherein the circuit board has a first conductor pattern that short-circuits the seventh and eighth terminal electrodes of the first pulse transformer and a second conductor pattern that short-circuits the third and fourth terminal electrodes of the first pulse transformer.

5. The circuit module as claimed in claim 4, further comprising a second pulse transformer having the same structure as the first pulse transformer, wherein the circuit board further has:

a second mounting area in which a second pulse transformer is mounted and which is disposed adjacent to the first mounting area in the second direction;

a third conductor pattern that short-circuits the fifth and sixth terminal electrodes of the second pulse transformer; and a fourth conductor pattern that short-circuits the first and second terminal electrodes of the second pulse transformer.

6. The circuit module as claimed in claim 5, wherein the first and third conductor patterns are short-circuited on the circuit board, and wherein the second and fourth conductor patterns are short-circuited on the circuit board.

7. An apparatus comprising:

a magnetic core;

first, second, third, and fourth wires wound around the magnetic core such that a coil axis of each of the first, second, third, and fourth wires is a first direction;

first, second, third, and fourth terminal electrodes arranged in a second direction substantially perpendicular to the first direction; and fifth, sixth, seventh, and eighth terminal electrodes arranged in the second direction, wherein the first wire has one end connected to one of the first and second terminal electrodes and other end connected to one of the seventh and eighth terminal electrodes, wherein the second wire has one end connected to other one of the first and second terminal electrodes and other end connected to other one of the seventh and eighth terminal electrodes, wherein the third wire has one end connected to one of the third and fourth terminal electrodes and other end connected to one of the fifth and sixth terminal electrodes, wherein the fourth wire has one end connected to other one of the third and fourth terminal electrodes and other end connected to other one of the fifth and sixth terminal electrodes, wherein the first and second terminal electrodes do not overlap with each of the seventh and eighth terminal electrodes in the second direction, and wherein the third and fourth terminal electrodes do not overlap with each of the fifth and sixth terminal electrodes in the second direction.

8. The apparatus as claimed in claim 7, wherein the first and third wires are wound around the magnetic core in a clockwise direction, and wherein the second and fourth wires are wound around the magnetic core in a counterclockwise direction.

* * * * *